US010752483B1

(12) United States Patent
Pittaway et al.

(10) Patent No.: US 10,752,483 B1
(45) Date of Patent: Aug. 25, 2020

(54) APPARATUS FOR DISPENSING A LIQUID FROM A LIQUID STORAGE CONTAINER

(71) Applicants: Clyde Pittaway, Durham (GB); Thomas James Coverdale, Durham (GB); Lee Higginbottom, Durham (GB); Graeme Thomas Leighton, Durham (GB)

(72) Inventors: Clyde Pittaway, Durham (GB); Thomas James Coverdale, Durham (GB); Lee Higginbottom, Durham (GB); Graeme Thomas Leighton, Durham (GB)

(73) Assignee: EBAC LIMITED (GB)

( * ) Notice: Subject to any disclaimer, the term of this patent is extended or adjusted under 35 U.S.C. 154(b) by 0 days.

(21) Appl. No.: 16/451,204

(22) Filed: Jun. 25, 2019

(51) Int. Cl.
*B67D 1/04* (2006.01)
*B67D 1/00* (2006.01)
(Continued)

(52) U.S. Cl.
CPC ..... *B67D 1/04* (2013.01); *B67D 1/0009* (2013.01); *B67D 1/0857* (2013.01);
(Continued)

(58) Field of Classification Search
CPC ..... B67D 1/04; B67D 1/0009; B67D 1/0857; B67D 1/0895; B67D 1/125; B67D 2001/0493; B67D 2001/0097
(Continued)

(56) References Cited

U.S. PATENT DOCUMENTS 3,881,636 A * 5/1975 D'Aubreby ..... B67D 1/0057 222/129.4
4,310,025 A * 1/1982 Tracy ..... B01F 3/0473 137/625.48
(Continued)

FOREIGN PATENT DOCUMENTS

WO WO2006018614 2/2006
WO WO2011024390 3/2011

*Primary Examiner* — Lien M Ngo
(74) *Attorney, Agent, or Firm* — Galbreath Law Offices, P.C.; John A. Galbreath

(57) ABSTRACT

The apparatus includes a housing having a dispensing location for liquid disposed above a repository for a liquid storage container. A pressurising assembly including an air pump supplies gas to pressurize the container and cause liquid to leave the container via a delivery tube. A replaceable flow assembly including a manifold 30 and a reservoir 18 conveys liquid from the delivery tube 16 to the reservoir and thence from the reservoir 18 to the dispensing location. The manifold has an underside which includes a riser tube connector 36 and a reservoir connector 40 to rigidly mount the manifold on the reservoir. An upper side of the manifold has an outlet 33 located directly above the reservoir connector 40. The manifold contains a chamber 58 configured to convey liquid from the riser tube connector 36 to the reservoir 18 and a connector 37 for feeding a second reservoir provided with a steam venting valve. A valve connector 47 connects the steam venting valve to an air passage 29 which travels through a lifting handle 46 to the reservoir 18 via the chamber 58. The flow assembly contains no check valves or bypass valves and is self-purging on replacement.

8 Claims, 5 Drawing Sheets

(51) Int. Cl.
*B67D 1/08* (2006.01)
*B67D 1/12* (2006.01)

(52) U.S. Cl.
CPC ..... *B67D 1/0895* (2013.01); *B67D 1/125* (2013.01); *B67D 2001/0097* (2013.01); *B67D 2001/0493* (2013.01)

(58) Field of Classification Search
USPC ..... 222/394, 395–399, 146.1, 129.1; 62/3.7, 62/3.64, 389–391
See application file for complete search history.

(56) References Cited

U.S. PATENT DOCUMENTS

| | | | | | |
|---|---|---|---|---|---|
| 4,958,747 | A * | 9/1990 | Sheets | B67D 1/0009 | 222/129 |
| 5,992,684 | A * | 11/1999 | Russell | B67D 1/006 | 222/1 |
| 2002/0125269 | A1* | 9/2002 | Lee | B67D 1/0009 | 222/67 |
| 2013/0048681 | A1* | 2/2013 | Walton | B67D 1/0057 | 222/333 |
| 2015/0060492 | A1* | 3/2015 | Orita | B67D 1/0009 | 222/146.6 |
| 2016/0016776 | A1* | 1/2016 | Orita | B67D 1/0895 | 222/146.1 |

* cited by examiner

APPARATUS FOR DISPENSING A LIQUID FROM A LIQUID STORAGE CONTAINER

TECHNICAL FIELD OF THE INVENTION

This invention relates to apparatus for dispensing a liquid such as water from a liquid storage container and a replacement flow assembly for use therein.

BACKGROUND

WO 2006 018 614 A1 discloses a replaceable flow assembly for use in a water cooler or similar bottled liquid dispenser. The flow assembly includes a liquid reservoir and a manifold incorporating a bottle connector for releasable sealing engagement with a neck formed on an inverted bottle. The manifold is mounted on the reservoir and incorporates a first pathway for conducting liquid from the bottle connector to the reservoir, and a second pathway for conducting liquid from the reservoir to a discharge outlet. A third pathway within the manifold conducts atmospheric air through an air filter and into the interior of the bottle through the delivery tube without passing through the reservoir. In a preferred embodiment the flow of liquid is assisted by an impeller which is incorporated in the manifold magnetically coupled to an external motor. Another embodiment is also described in which an external air pump pressurizes the bottle via the third pathway.

Bottled liquid dispensers also frequently include a hot tank which receives ambient water from the bottle and which incorporates a heating element to provide a supply of hot water at a separate discharge outlet. Water may leave the hot tank via a steam valve which automatically vents gases to prevent a dangerous pressure build-up.

In common with most contemporary water coolers, which are often referred to as "top loaders", the bottle has to be inverted and lifted onto the top of the cooler. WO 2003 062 131 A1 discloses a water cooler in which the bottle does not need to be inverted and is placed in the bottom of the cooler—therefore known as a "bottom loader". A liquid pump draws water from the bottle via a non-return valve. In one embodiment a passage with a flow restriction bypasses the non-return valve to prevent over-pressure in the system.

Replaceable flow assemblies as in WO 2006 018 614 A1 permit quick and easy sanitization of the water cooler by replacing the water contacting surfaces in a single operation. In bottom loaders however, the need to maintain adequate dispensing pressures makes it more difficult to provide a low cost and easily replaceable flow assembly. Furthermore, tortuous flow paths and complex valve arrangements can reduce flow rates and produce undesirable heat transfer to or from the various flow paths.

Various problems have been encountered with replaceable flow assemblies. Firstly, during replacement of the flow assembly there may be a tendency for water to spill out of the water inlet. A second problem is that in some circumstances the steam valve may permit the hot tank to siphon back into the bottle and empty. In bottom loaders a non-return valve and pressure relief valve may be included in the flow path from the bottle, but this adds to the cost of the assembly, and if the valves should fail back-siphoning can still occur. Another problem which has been encountered is that the cold reservoir does not always fill consistently. Ideally the unit will prime consistently and automatically when the flow assembly has been changed.

SUMMARY OF THE INVENTION

When viewed from one aspect the present invention proposes apparatus for dispensing a liquid from a liquid storage container associated with the apparatus, which includes:

- a housing having a dispensing location from which liquid from a liquid storage container is dispensed, and a repository to receive said liquid storage container;
- a first reservoir disposed in the housing, the first reservoir being configured to receive a liquid from the liquid storage container before the liquid is dispensed from the dispensing location;
- a second reservoir disposed in the housing, the second reservoir being configured to receive a liquid from the liquid storage container before the liquid is dispensed from the dispensing location, the second reservoir being provided with an automatic gas-venting valve;
- a delivery tube to convey liquid from said liquid storage container;
- a first transfer conduit to convey liquid from the first reservoir to the dispensing location;
- a second transfer conduit to convey liquid from the second reservoir to the dispensing location;

and

- a manifold operably connected to the delivery tube and the first and second reservoirs to convey liquid from said liquid storage container to both of said reservoirs, and operably connected to the first reservoir to convey liquid from the first reservoir towards said dispensing location via said first transfer conduit, said manifold having:
  - an inlet to admit liquid from the delivery tube to the manifold,
  - a first reservoir connector to rigidly mount the manifold on the first reservoir,
  - a second reservoir connector to connect the manifold to the second reservoir,
  - a valve connector for connection to the automatic gas-venting valve,
  - a pathway to convey liquid from the inlet to the first reservoir via said first reservoir connector and to the second reservoir via said second reservoir connector,
  - an outlet passage to convey liquid from the first reservoir towards the dispensing location via the first reservoir connector, and
  - an air passage configured to admit air from the automatic gas-venting valve to the first reservoir via the valve connector.

In a preferred embodiment the manifold incorporates a lifting handle and the air passage travels along said lifting handle.

In a preferred embodiment of the dispensing apparatus the air passage incorporates an air flow restriction.

In a preferred form of dispensing apparatus the dispensing location is disposed above at least a portion of the repository and a pressurising assembly is disposed in the housing to supply a gas under pressure into said liquid storage container.

The pressurising assembly preferably includes an air pump and an over-pressure release valve.

The invention also provides a replacement flow assembly for use in the apparatus, which includes the manifold and the reservoir.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Embodiments of the present invention may be applied to various kinds of dispensing apparatus which require liquid to be withdrawn from a container. By way of example a preferred form of liquid dispensing apparatus will be described with reference to FIGS. 1 and 2.

Figure 1:
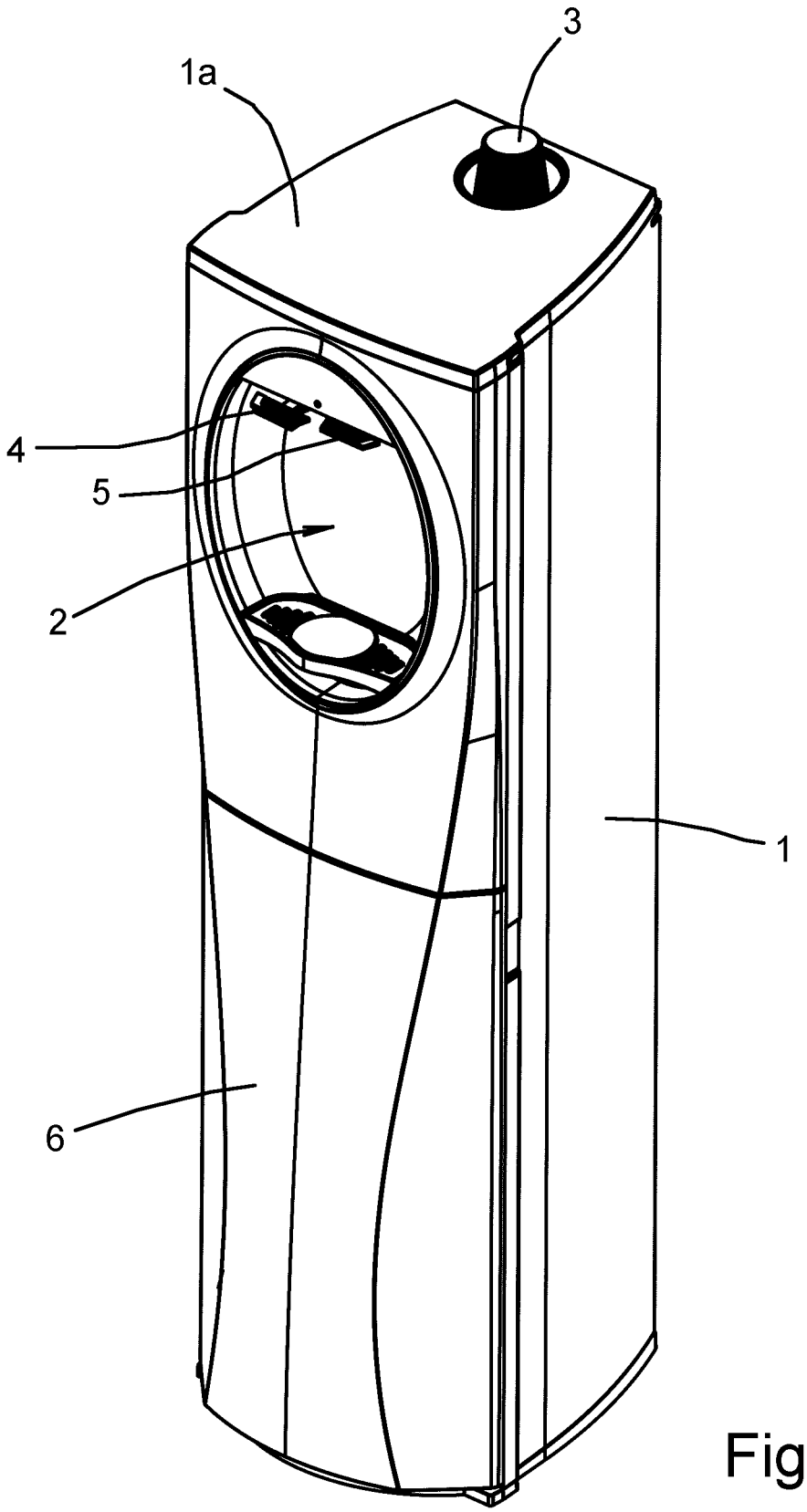
FIG. 1 is a general external view of a bottled water dispenser of the kind known as a bottom loader.

Referring firstly to FIG. 1, apparatus for dispensing a liquid has an external housing 1 with a removable lid 1*a*, and includes a dispensing location 2 in the form of a recess occupying a front portion of the housing, within which water can be dispensed into cups removed from a supply of cups 3. In this embodiment the user has the option of dispensing chilled water or hot water by operating respective dispensing valves 4 and 5. Beneath the dispensing location 2 a bottom portion of the housing is occupied by a repository 6 having a front access door through which may be loaded a liquid storage container in the form of a bottle.

Figure 2:
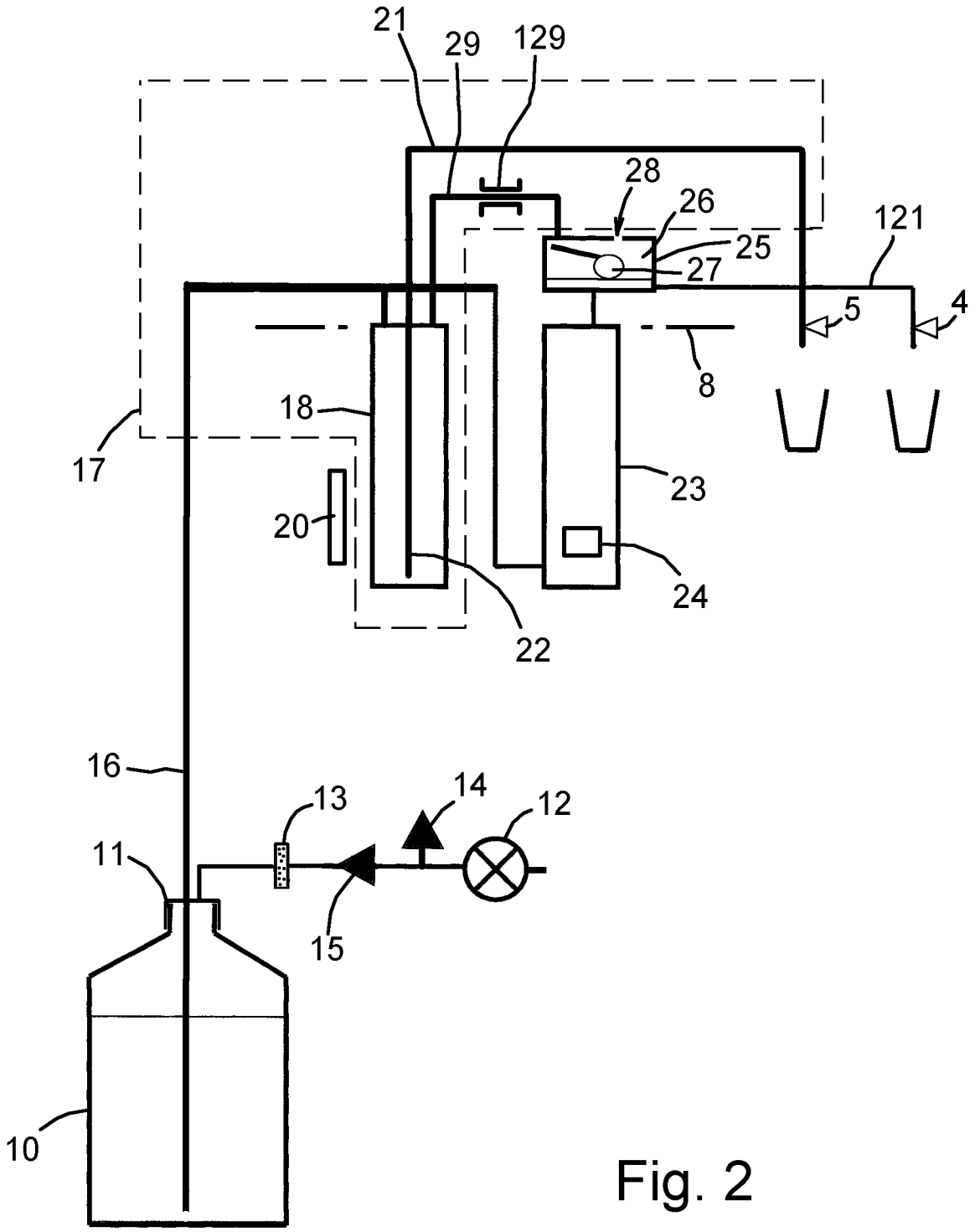
FIG. 2 is a schematic drawing showing the layout of the main internal components of the bottled water dispenser.

Referring to FIG. 2, a bottle 10 containing water is loaded into the repository 6 with its neck uppermost. A releasable bottle connector 11 is sealingly engaged with the neck of the bottle, via which a pressurising assembly including an air pump 12 supplies air under pressure to pressurise the bottle. The bottle connector 11 may incorporate an air filter 13. The outlet of the pump supplies the bottle via a non-return valve 15 to maintain pressurisation of the bottle and is provided with an over-pressure release valve 14. The pump may be associated with a pressure sensor so that the pump only operates when necessary to maintain adequate pressurisation of the bottle. The over-pressure release valve 14 may vent air to atmosphere and limit any pressure rise within the bottle. The increased air pressure which the pump creates within the bottle enables ambient water to pass out of the bottle through a delivery tube 16 to a replaceable flow assembly 17 which incorporates a first reservoir 18.

Water within the reservoir 18 may be chilled by means of a conventional cooling element 20. When it is desired to dispense chilled water at the dispensing location 2, operation of the cold valve 5 opens a first transfer conduit 21 through which water may flow from the reservoir 18 via a dip tube 22 which extends to the bottom of the reservoir.

Hot water may also be dispensed from a second reservoir in the form of a hot tank 23 which is provided with a suitable heating element 24. The hot tank is filled with ambient water from the flow assembly 17 and supplies the hot tap 4 via an automatic gas-venting valve 25 and a second transfer conduit 121. A preferred form of gas-venting valve has a chamber 26 through which passes hot water from the top of the hot tank 23 on its way to the hot tap 4. The chamber 26 contains a float 27 which normally closes a gas vent 28, but when steam, air or other gases are present in the chamber the float falls to allow the gases to escape through the vent.

In the illustrated flow assembly the top of the chamber 26 is connected by an air passage 29 to the top of the cold reservoir 18. The air passage incorporates a flow restriction 129, such as a small bore tube, the function of which is explained below.

It will be noted that no check valves or pressure relief valves are incorporated in the water flow path.

If required, ambient water from the flow assembly could also flow directly to an ambient water dispensing valve at the dispensing location 2.

Figure 3:
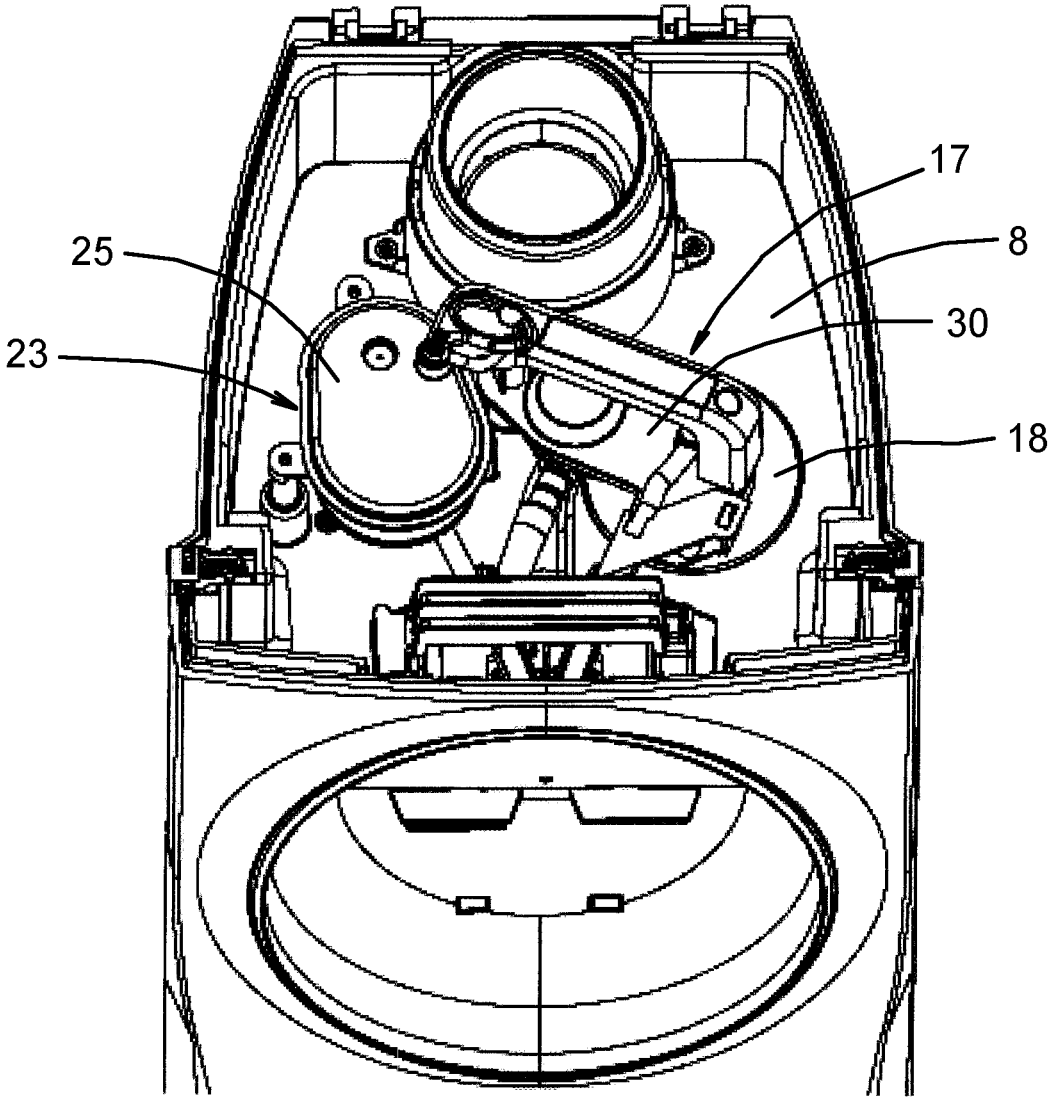
FIG. 3 is a general view of a top part of the bottled water dispenser, looking from above with its lid removed.

Referring to FIG. 3, which shows the dispensing apparatus with its lid 1*a* removed, the top of the cold reservoir 18 and the top of the hot tank 23 are both disposed at substantially the same level, flush with an internal partition wall 8 (also indicated in FIG. 2). The gas-venting valve 25 is mounted on top of the hot tank 23 above the partition wall 8. The flow assembly 17 includes a manifold 30 and the cold reservoir 18. Since the hot tank 23 and its connecting pipework are effectively sanitized by the temperature of the hot water it is not normally necessary to replace them as part of the flow assembly.

Figure 4:
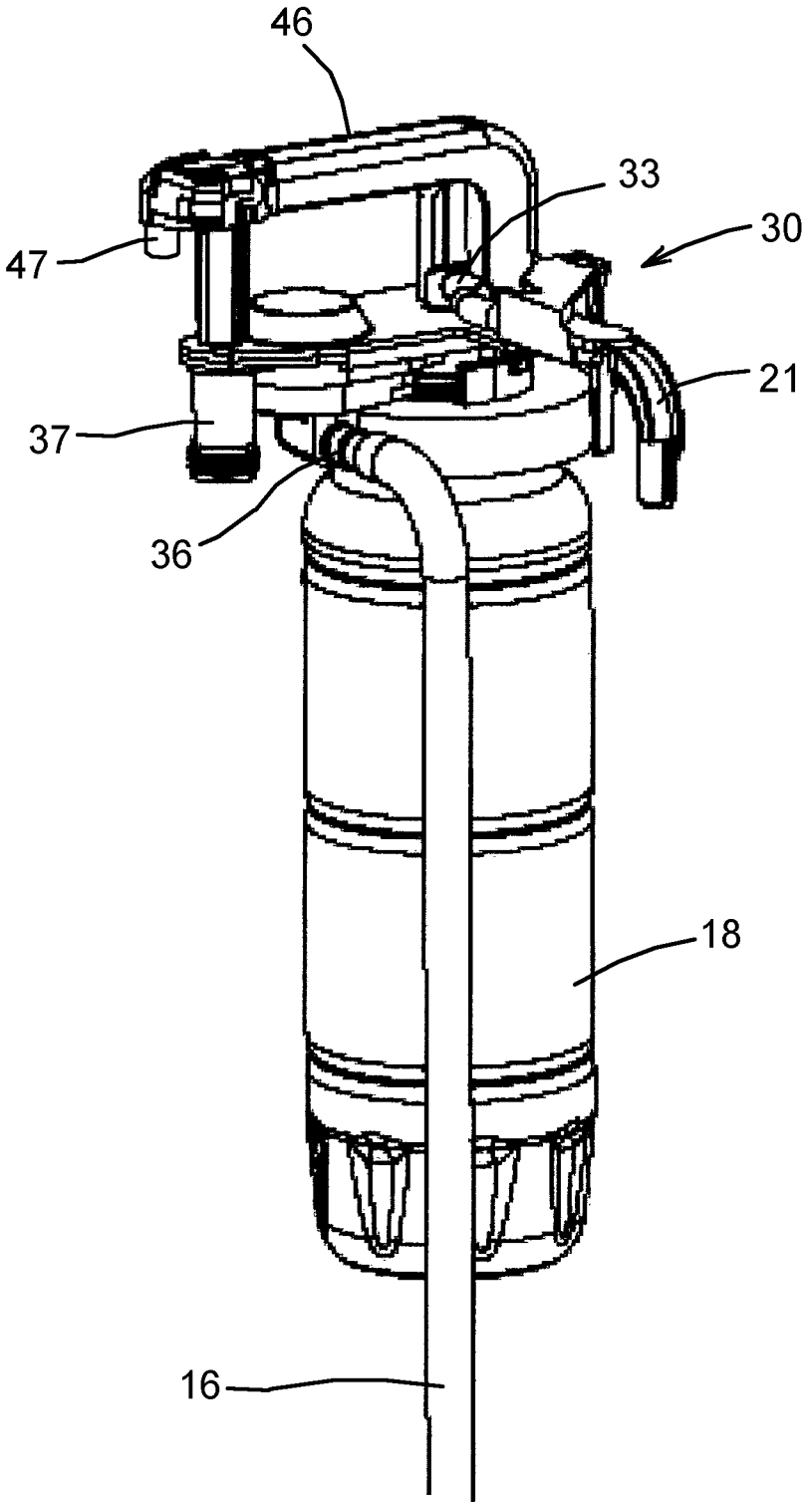
FIG. 4 is a general view of the flow assembly of the bottled water dispenser, including a manifold and cold water reservoir.
Figure 5:
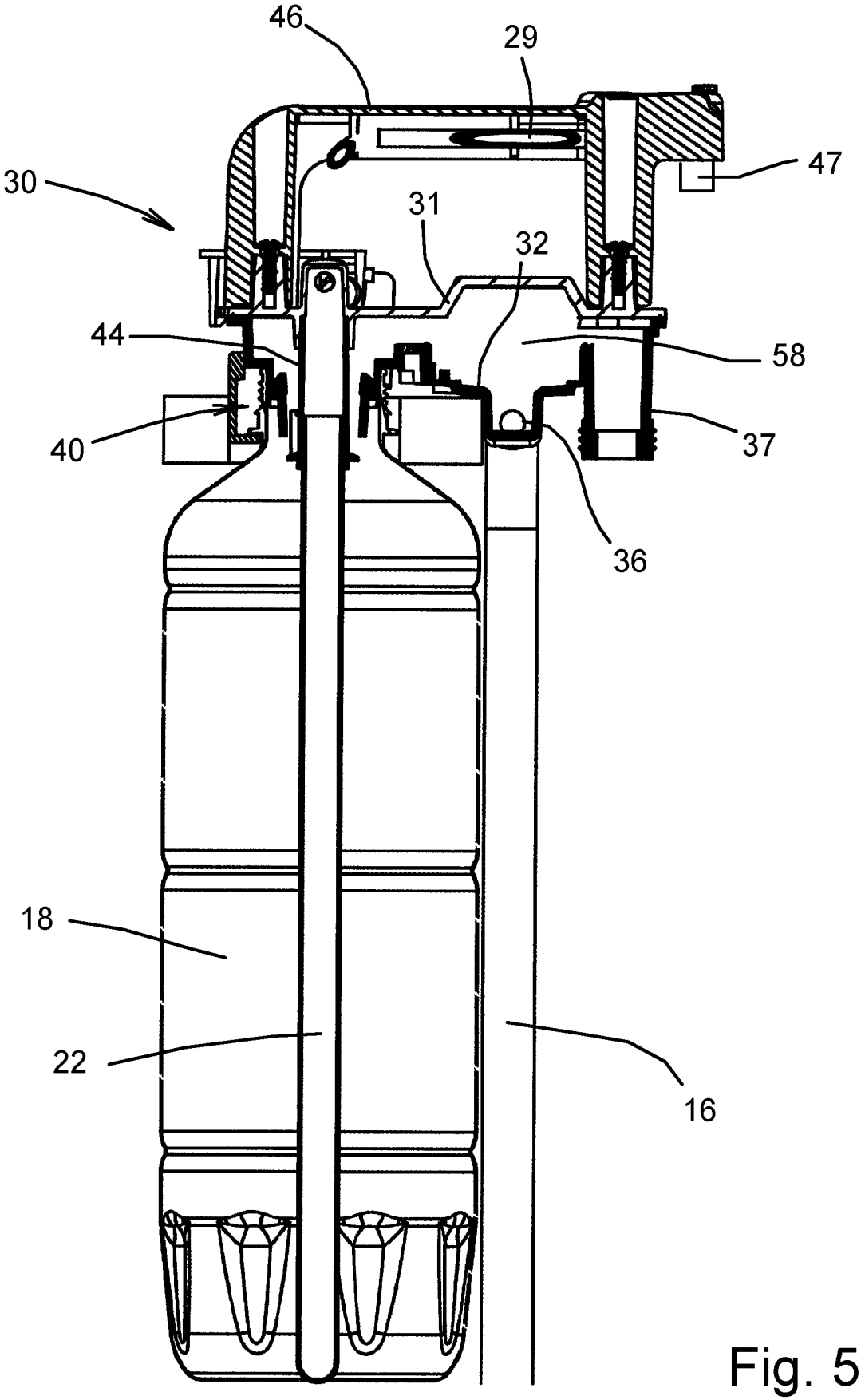
FIG. 5 is a vertical section through the flow assembly.

The replaceable flow assembly is shown removed from the dispensing apparatus in FIGS. 4 and 5. The manifold 30 may be formed from upper and lower components 31 and 32. The upper component 31 provides the upper side of the manifold which has an outlet 33 for connection to the first transfer conduit 21. The transfer conduit 21 may comprise a flexible length of tubing which is joined to the outlet connector 33 but at least part of the transfer conduit 21 could be integral with the manifold. The lower component 32 provides the underside of the manifold which includes an inlet 36 for connection to the delivery tube 16. The underside of the manifold is also provided with a first reservoir connector 40 which is sealingly engaged with the neck of the reservoir 18. The reservoir may be blow moulded of PET or a similar polymer, and is rigidly secured to the lower component 32 by the connector 40. The reservoir connector 40 also includes an inner co-axial tubular portion 44 which connects with the dip tube 22. The upper end of the tubular portion 44 extends upwards through the manifold to sealingly engage the outlet 33 of the upper component 31. The manifold also has a second reservoir connector 37, which is preferably a plug-in connector, to supply ambient water to the hot tank 23.

The upper component 31 of the manifold 30 incorporates an inverted-U shaped handle 46 by which the flow assembly (manifold 30 and reservoir 18) can be lifted in and out of the housing 1. The manifold 30 contains a flow chamber 58 which provides a pathway to convey liquid from the inlet 36 to the reservoir 18 via the reservoir connector 40 and also convey liquid to the hot tank 23 via the second reservoir connector 37. One end of the handle 46 is located adjacent to the reservoir connector 40. The second end of the handle is located above the second reservoir connector 37 and incorporates a valve connector 47 which projects downward to sealably engage the top of the automatic gas-venting valve 25. Air passage 29 travels through the handle and is configured to admit air from the automatic gas-venting valve 25 to the cold reservoir 18 via the valve connector 47 and the flow chamber 58.

When either of the dispensing valves 4 or 5 is opened the pressurisation of the bottle 10 causes ambient water to flow through the delivery tube 16 into the flow chamber 58. From the flow chamber ambient water can travel to the hot tank via the second reservoir connector 37. When the cold dispensing valve 5 is opened, ambient water enters the reservoir 18 through the outer part of the reservoir connector 40. Water entering the reservoir displaces chilled water from the bottom of the reservoir which flows up the dip tube 22 and through the straight inner portion 44 of the reservoir connector which passes transversely through the flow chamber 58 before entering the conduit 21 via outlet 33. Since the period of thermal contact across the wall of the tubular portion 44 is only brief there is little thermal transfer between the ambient water and the chilled water.

When the flow assembly is replaced as part of a routine maintenance program the pump is turned off and the hot and cold taps 4 and 5 are opened allowing air to enter the steam-venting valve 25 through the vent port 28. The taps 4 and 5 are held open so that the water level will continue to drop until it reaches the top of the hot and cold reservoirs 18 and 23 when the air break provided via the air passage 29 prevents the tanks from emptying. The restriction 129 in the air passage 29 slows down the entry of air into the flow chamber 58 and allows more water to drain back into the bottle 10. This helps to ensure that the final water level in the flow chamber 58 is lower than the second reservoir connector 37, and the manifold 30 and cold reservoir 18 can be lifted out of the dispenser without risk of spillage.

The delivery tube 16 may be replaced together with the manifold 30 and reservoir 17 along with the flexible tube 21 which leads to the cold dispensing valve 5. The bottle connector 11 may also be replaceable, but the air pump 12 is not part of the replaceable flow assembly and will normally be a fixed part of the dispenser.

The incorporation of the air passage 29 improves the priming of the system after the new flow assembly has been installed. When the pump is started the cold reservoir will fill automatically with air being purged through the air passage 29 and vent 28. The hot reservoir 23 will also fill until the water level reaches the steam-venting valve 25 causing it to close the vent 28. The pump may be signaled to run for a period which is sufficient to fully purge the system, e.g. by depressing both taps simultaneously. When the system is fully purged of air the pressure relief valve 14 vents excess air until the pump shuts down.

In addition to self-priming and low risk of spillage the manifold which is part of the replaceable flow assembly has a small volume, a minimum number of components, allows free flow through all the necessary flow paths, and permits rapid dispensing of chilled liquid with minimum heat transfer between flow paths. The lack of check valves or pressure relief valves in the water flow path also means that the flow assembly is relatively inexpensive.

The flow assembly is designed to be a low cost disposable unit which can be changed at recommended service intervals, typically every 3 to 6 months. The configuration of the flow assembly, and the provision of a handle in a convenient position and orientation, means that it is very easy for the user to remove the flow assembly and re-insert a new one. The structure of the flow assembly also enables it to be manufactured from materials which do not impart any taste to the water.

Although the flow assembly has been described in relation to a bottom loader it could also have similar advantages when used with top-loading coolers without a pressurising pump. The apparatus may also be used for dispensing liquids other than plain water such as carbonated liquids, fruit juices etc. Instead of an air pump 12 the bottle may be pressurized by other means such as a $CO_2$ cylinder.

Whilst the above description places emphasis on the areas which are believed to be new and addresses specific problems which have been identified, it is intended that the features disclosed herein may be used in any combination which is capable of providing a new and useful advance in the art.

The invention claimed is:

1. Apparatus for dispensing a liquid from a liquid storage container associated with the apparatus:

a housing having a dispensing location from which liquid from a liquid storage container is dispensed, and a repository to receive said liquid storage container;

a first reservoir disposed in the housing, the first reservoir being configured to receive a liquid from the liquid storage container before the liquid is dispensed from the dispensing location;

a second reservoir disposed in the housing, the second reservoir being configured to receive a liquid from the liquid storage container before the liquid is dispensed from the dispensing location, the second reservoir being provided with an automatic gas-venting valve;

a delivery tube to convey liquid from said liquid storage container;

a first transfer conduit to convey liquid from the first reservoir to the dispensing location;

a second transfer conduit to convey liquid from the second reservoir to the dispensing location;

a manifold operably connected to the delivery tube and the first and second reservoirs to convey liquid from said liquid storage container to both of said reservoirs, and operably connected to the first reservoir to convey liquid from the first reservoir towards said dispensing location via said first transfer conduit, said manifold having:

an inlet to admit liquid from the delivery tube to the manifold, a first reservoir connector to rigidly mount the manifold on the first reservoir, a second reservoir connector to connect the manifold to the second reservoir, a valve connector for connection to the automatic gas-venting valve, a pathway to convey liquid from the inlet to the first reservoir via said first reservoir connector and to the second reservoir via said second reservoir connector, an outlet passage to convey liquid from the first reservoir towards the dispensing location via the first reservoir connector, and an air passage configured to admit air from the automatic gas-venting valve to the first reservoir via the valve connector.

2. Apparatus according to claim 1 in which the manifold incorporates a lifting handle and the air passage travels along said lifting handle.

3. Apparatus according to claim 1 in which the air passage incorporates an air flow restriction.

4. Apparatus according to claim 1 in which the dispensing location is disposed above at least a portion of the repository and a pressurising assembly is disposed in the housing to supply a gas under pressure into said liquid storage container.

5. Apparatus according to claim 4 in which the pressurising assembly includes an air pump, a non-return valve and an over-pressure release valve.

6. A flow assembly for use in apparatus for dispensing a liquid from a liquid storage container associated with the apparatus, which includes a first reservoir to receive a liquid from a liquid storage container via a delivery tube and a manifold operably connected to the first reservoir to convey liquid from said liquid storage container to the first reservoir and convey liquid from the first reservoir towards a dispensing location, said manifold having:

an inlet to admit liquid from the delivery tube to the manifold, a first reservoir connector to rigidly mount the manifold on the first reservoir, a second reservoir connector to connect the manifold to a second reservoir, a valve connector for connection to an automatic gas-venting valve associated with the second reservoir, a pathway to convey liquid from the inlet to the first reservoir via said first reservoir connector and to the second reservoir via said second reservoir connector, an outlet passage to convey liquid from the first reservoir towards the dispensing location via the first reservoir connector, and an air passage configured to admit air from the automatic gas-venting valve to the first reservoir via the valve connector.

7. A flow assembly according to claim 6 in which the manifold incorporates a lifting handle and the air passage travels along said lifting handle.

8. A flow assembly according to claim 6 in which the air passage incorporates an air flow restriction.

* * * * *